US008567618B2

(12) United States Patent
Tan

(10) Patent No.: US 8,567,618 B2
(45) Date of Patent: Oct. 29, 2013

(54) BAG DISPENSER RACK

(76) Inventor: Daniel Brian Tan, Harahan, LA (US)

( * ) Notice: Subject to any disclaimer, the term of this patent is extended or adjusted under 35 U.S.C. 154(b) by 0 days.

(21) Appl. No.: 12/947,622

(22) Filed: Nov. 16, 2010

(65) Prior Publication Data

US 2012/0118839 A1 May 17, 2012

(51) Int. Cl.
*A47G 29/00* (2006.01)

(52) U.S. Cl.
USPC ..... 211/85.15

(58) Field of Classification Search
USPC ..... 211/85.15, 12, 106, 57.1, 59.1; 248/95, 248/100; 383/12, 22, 23
See application file for complete search history.

(56) References Cited

U.S. PATENT DOCUMENTS 292,648 A * 1/1884 Hayman ..... 248/97
746,988 A * 12/1903 Olin ..... 248/97
1,411,895 A * 4/1922 Allen ..... 211/57.1
2,513,474 A * 7/1950 Greer ..... 211/50
2,673,016 A * 3/1954 Gerbe ..... 53/572
2,788,822 A * 4/1957 Parker ..... 206/554
2,899,161 A * 8/1959 Bayard ..... 248/101
3,100,569 A * 8/1963 White ..... 206/493
3,140,070 A * 7/1964 Doebele ..... 248/97
3,140,558 A * 7/1964 Cassidy ..... 248/449
3,180,494 A * 4/1965 Levy ..... 211/64
3,312,339 A * 4/1967 Million ..... 206/493
3,352,411 A * 11/1967 Schwarzkopf ..... 206/493
3,375,960 A * 4/1968 Stevens et al. ..... 224/42.11
3,454,166 A * 7/1969 Dinges ..... 211/57.1
3,514,015 A * 5/1970 Hein ..... 221/47
3,515,283 A 6/1970 Poteat
3,603,542 A * 9/1971 Grille ..... 248/98
3,747,298 A * 7/1973 Lieberman ..... 53/390
3,770,134 A * 11/1973 Kupcikevicius ..... 211/57.1
3,771,645 A * 11/1973 Wendel ..... 206/449
3,918,589 A * 11/1975 Nausedas ..... 211/57.1
4,046,257 A * 9/1977 Lehmacher ..... 206/544
4,094,415 A * 6/1978 Larson ..... 211/57.1
4,262,803 A * 4/1981 Nausedas et al. ..... 206/554
4,519,504 A * 5/1985 Nausedas ..... 206/554
4,527,693 A * 7/1985 Membrino ..... 206/554
4,537,330 A * 8/1985 Gelbard ..... 221/26
4,579,307 A * 4/1986 Malik ..... 248/99
4,676,378 A * 6/1987 Baxley et al. ..... 206/554
4,750,694 A * 6/1988 Bateman ..... 248/97
4,821,985 A * 4/1989 DeMatteis et al. ..... 248/97
4,840,336 A * 6/1989 Stroh et al. ..... 248/97
4,863,125 A 9/1989 Bateman (Continued)

*Primary Examiner* — Darnell Jayne
*Assistant Examiner* — Kimberley S Wright
(74) *Attorney, Agent, or Firm* — David A. Belasco; Belasco Jacobs & Townsley, LLP

(57) ABSTRACT

A bag dispenser rack, includes a first bag pack support tray that has a first base, a first left side wall, a first right side wall, a first back wall, a first front wall and holds a first merchandise bag pack. The first front wall has a first opening that permits extraction of first bags from the first pack. A second bag pack support tray has a second base, a second left side wall, a second right side wall, a second back wall, a second front wall and holds a second merchandise bag pack. The second front wall has a second opening to permit extraction of second bags from the second pack. The second bag pack support tray is hingedly attached to the first bag pack support tray. The second bag pack support tray pivots upwardly to permit loading of a first bag pack into the first bag pack tray.

26 Claims, 16 Drawing Sheets

(56) References Cited

U.S. PATENT DOCUMENTS

| | | | | | |
|---|---|---|---|---|---|
| 4,981,216 | A | * | 1/1991 | Wilfong, Jr. | 206/554 |
| 5,183,158 | A | * | 2/1993 | Boyd et al. | 206/554 |
| 5,213,145 | A | * | 5/1993 | Huang et al. | 141/391 |
| 5,269,423 | A | | 12/1993 | Nguyen | |
| 5,301,823 | A | * | 4/1994 | Kingery | 211/85.6 |
| 5,405,021 | A | | 4/1995 | Smithson | |
| RE35,207 | E | | 4/1996 | Daniels | |
| 5,509,570 | A | * | 4/1996 | DeMatteis | 221/33 |
| 5,524,763 | A | * | 6/1996 | Wile | 206/554 |
| 5,575,393 | A | * | 11/1996 | Gebhardt | 206/554 |
| 5,871,115 | A | | 2/1999 | Kohn | |
| 5,979,841 | A | * | 11/1999 | Piraneo et al. | 248/95 |
| 5,996,801 | A | | 12/1999 | Tsu | |
| 6,012,594 | A | * | 1/2000 | Heinz | 211/46 |
| 6,089,514 | A | | 7/2000 | Huang et al. | |
| 6,098,806 | A | * | 8/2000 | Mills | 206/554 |
| 6,264,035 | B1 | * | 7/2001 | Petrie | 206/554 |
| 6,264,059 | B1 | * | 7/2001 | Requena | 221/45 |
| 6,267,334 | B1 | * | 7/2001 | Siu | 248/97 |
| 6,394,309 | B1 | * | 5/2002 | Fainberg | 221/278 |
| 6,502,371 | B2 | | 1/2003 | DeMatteis | |
| 6,505,750 | B1 | * | 1/2003 | Nguyen | 211/163 |
| 6,543,638 | B2 | * | 4/2003 | Wile | 221/1 |
| 6,578,729 | B2 | * | 6/2003 | Grinberg | 221/26 |
| 6,640,982 | B1 | * | 11/2003 | Bjerke | 211/85.15 |
| 6,655,546 | B1 | * | 12/2003 | Bolton et al. | 221/45 |
| 6,729,483 | B1 | * | 5/2004 | Nguyen et al. | 211/163 |
| 7,128,251 | B1 | * | 10/2006 | Galle | 225/2 |
| D552,901 | S | * | 10/2007 | Wilfong et al. | D6/515 |
| 7,424,963 | B2 | * | 9/2008 | Daniels | 225/93 |
| 7,611,019 | B2 | * | 11/2009 | Alvarado | 211/85.15 |
| 7,926,669 | B2 | * | 4/2011 | Alvarado | 211/85.15 |
| 8,067,072 | B2 | * | 11/2011 | Tan | 428/35.7 |
| 8,397,923 | B2 | * | 3/2013 | Tan | 211/85.15 |
| 2007/0176058 | A1 | * | 8/2007 | Kohn et al. | 248/100 |
| 2008/0149785 | A1 | * | 6/2008 | Galle | 248/97 |

* cited by examiner

BAG DISPENSER RACK

FIELD OF INVENTION

This invention relates to the field of packaging dispensing systems, and more specifically to space efficient dispensing systems for merchandise bags.

BACKGROUND OF THE INVENTION

Counter space in grocery stores, supermarkets and other retail establishments is often at a premium. Most of these businesses provide disposable merchandise bags for their customers to use in transporting their purchases. When using film bags, such as those made of thermoplastics or similar materials, it is desirable that the bag dispensing systems provide bags that are self-opening. Typically, self-opening bag dispensing systems require a rack that holds a pack of merchandise bags on a central hook and a pair of horizontal arms. Such dispensing systems are usually placed on top of a check-out counter and require a square foot of counter space or more, depending upon the bag size. If more than one size of self-opening bags can be conveniently dispensed using this counter space, merchandise can be more efficiently handled at check-out counters.

U.S. Pat. No. 6,543,638, issued to Wile, discloses a method and means of dispensing T-shirt type bags. The dispensing rack described may be mounted beneath a counter from a tray which slides horizontally and is pulled forward and tilted downward in order to load the bags into the rack. The system may utilize a second tray that is held within the same frame so that it can hold two different size bags allowing a single person to dispense one of two different size bags when needed. The bag packs utilized in this device have two punched holes for mounting on the rack trays and have frangible bonds to the outside of the handle area which allow the bags to be bonded together to form the bag pad. The tray has spikes which are used to receive a bundle of plastic bags which have mounting holes. It is possible to use two trays with the frame so that a first tray is used at the lower level of the rails and another at a higher level. A lower rack with a pad of larger bags on the lower level and a pad of smaller bags on the upper tray allows the user to tear off a small bag or a large bag depending upon the need.

U.S. Pat. No. 6,089,514, issued to Huang et al. is directed to a swing-arm bagging rack for supporting multiple styles of packs of plastic bags. The device is intended to support multiple sizes and styles of bags in a space saving manner and may be swung into a closed position in order to conserve space when not in use. The rack comprises a series of moveable arm portions which are movably attached to the back portion and positioned so as to accommodate various sizes and styles of flexible bags. The spherical ball or balls or rods may be eased out of notches and ride on the upper surface of the portion so as to lock the arms in various positions to accommodate the support and dispensing of a plurality of styles and sizes of bag packs.

U.S. Pat. No. 4,676,378, issued to Baxley et al. illustrates a bag pack that contains a plurality of plastic bags that have aligned mounting apertures defined through the handles thereof for reception of the mounting rods from a rack. The mounting rods form a portion of the rack system holding a plurality of plastic bags that are aligned by spikes passing through the apertures found in the bag. This patent also provides an example of an automatic following and opening of the bags during the loading and operation wherein the rear panel of each bag is provided with a minor area of disengageable adhesive which bonds to the forward panel of the following or underlying bag. Thus, when the first bag is removed the adhesive portion adheres to the front wall of a succeeding bag pulling it forward and thus opening the bag for receiving materials after the first bag is removed.

U.S. Pat. No. 5,996,801, issued to Tsu disclose a plastic T-shirt shopping bag pack and provides another but slightly different method of opening the bag mouth of the next ensuing bag when the first bag is removed from a rack.

It is an objective of the present invention to provide a dispensing system for self-opening merchandise bags that makes maximum use of check-out counter space. It is a further objective to provide such a system that can be mounted on top of a check-out counter or other horizontal surface. It is yet a further objective to provide a dispenser that can accommodate more than one size of bag. It is a still further objective of the invention to provide a bag dispensing system that is easy to load and provides visual inventory of the bags remaining in the bag pack. It is another objective to provide a dispenser that can handle t-shirt style bags as well as header bags. It is another objective to provide a dispenser that can accommodate advertising on an upper surface. Finally, it is an objective of the present invention to provide a dispensing system that is durable, inexpensive and simple for check-out personnel to operate.

While some of the objectives of the present invention are disclosed in the prior art, none of the inventions found include all of the requirements identified.

SUMMARY OF THE INVENTION

The present invention addresses all of the deficiencies of prior art bag dispenser rack inventions and satisfies all of the objectives described above.

(1) A bag dispenser rack providing the desired features can be constructed from the following components. A first bag pack support tray is provided. The first support tray has a first base, a first left side wall, a first right side wall, a first back wall, a first front wall and is sized and shaped to hold a first merchandise bag pack. The first front wall has a first opening. The first opening is sized and shaped to permit extraction of first bags from the first bag pack.

(2) In a variant of the invention, a cover plate is provided. The cover plate is sized and shaped to cover at least a portion of the first bag pack support tray. The cover plate provides either a loading surface or an advertising display surface above the first bag pack support tray.

(3) In another variant, the cover plate is hingedly attached adjacent one of the first left side wall, the first right side wall, the first back wall and the first front wall.

(4) In yet another variant, a second bag pack support tray is provided. The second support tray has a second base, a second left side wall, a second right side wall, a second back wall, a second front wall and is sized and shaped to hold a second merchandise bag pack. The second front wall has a second opening. The second opening is sized and shaped to permit extraction of second bags from the second bag pack. The second bag pack support tray is located on the first bag pack support tray.

(5) In still another variant, the second bag pack support tray is secured to the first bag pack support tray with at least one attachment mechanism.

(6) In a further variant, the at least one attachment mechanism is selected from the group that includes pins and sockets, buckles and clips.

(7) In still a further variant, the second bag pack support tray is hingedly attached adjacent a lower edge of the second back wall adjacent an upper edge of the first back wall. The second bag pack support tray pivots upwardly to permit loading of a first bag pack into the first bag pack support tray.

(8) In yet a further variant, a cover plate is provided. The cover plate is sized and shaped to cover at least a portion of the second bag pack support tray. The cover plate provides either a loading surface or an advertising display surface above the second bag pack support tray.

(9) In another variant, the cover plate is hingedly attached adjacent the one of the second left side wall, the second right side wall, the second back wall and the second front wall.

(10) In yet another variant, the cover plate further includes at least one downward facing side ledge. The side ledge is located at at least one of first and second side edges of the cover plate. The side ledge is sized and shaped to extend downwardly over upper edges of at least one of the first left side wall and the first right side wall, thereby stabilizing the cover plate on the first bag pack support tray.

(11) In still another variant, the cover plate further includes at least one downward facing side ledge. The side ledge is located at at least one of first and second side edges of the cover plate. The side ledge is sized and shaped to extend downwardly over upper edges of at least one of the second left side wall and the second right side wall, thereby stabilizing the cover plate on the second bag pack support tray.

(12) In a further variant of the invention, at least one mounting spike is provided. The at least one mounting spike extends upwardly from the first base for a first predetermined distance and is located to align with an aperture extending through the first bag pack.

(13) In yet a further variant, the at least one mounting spike is removably attached to the first base.

(14) In still a further variant, the at least one mounting spike is movably attached to the first base, thereby providing alternative locations for the mounting spike on the first base.

(15) In another variant of the invention, at least one securing hook is provided. The at least one securing hook is attached to the first base and is located to align with an aperture extending through the first bag pack.

(16) In still another variant, the at least one securing hook is removably attached to the first base.

(17) In yet another variant, the at least one securing hook is movably attached to the first base, thereby providing alternative locations for the securing hook on the first base.

(18) In still another variant, at least one mounting spike is provided. The at least one mounting spike extends upwardly from at least one of the first base and the second base for a first predetermined distance and is located to align with an aperture extending through either of the first bag pack and the second bag pack.

(19) In a further variant, the at least one mounting spike is removably attached to at least one of the first base and the second base.

(20) In still a further variant, the at least one mounting spike is movably attached to at least one of the first base and the second base, thereby providing alternative locations for the mounting spike on at least one of the first base and the second base.

(21) In yet a further variant, at least one securing hook is provided. The at least one securing hook is attached to at least one of the first base and the second base and is located to align with an aperture extending through at least one of the first bag pack and the second bag pack.

(22) In another variant of the invention, the at least one securing hook is removably attached to at least one of the first base and the second base.

(23) In still another variant, the at least one securing hook is movably attached to at least one of the first base and the second base, thereby providing alternative locations for the securing hook on at least one of the first base and the second base.

(24) In yet another variant, the first bag pack support tray is formed from materials selected from the group that includes wire, injection molded material, sheet metal and wood.

(25) In a further variant, at least one of the first bag pack support tray and the second bag pack support tray is formed from materials selected from the group that includes wire, injection molded material, sheet metal and wood.

(26) In still a further variant, the first bag pack support tray is sized and shaped to hold a plurality of merchandise bags in a stacked configuration.

(27) In yet a further variant, at least one of the first bag pack support tray and the second bag pack support tray is sized and shaped to hold a plurality of merchandise bags in a stacked configuration.

(28) In another variant of the invention, the first bag pack support tray is sized and shaped to hold a plurality of merchandise bags in a folded configuration.

(29) In a final variant of the invention, at least one of the first bag pack support tray and the second bag pack support tray is sized and shaped to hold a plurality of merchandise bags in a folded configuration.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1-14 illustrate a bag dispenser rack 10 providing the desired features that may be constructed from the following components. As illustrated in FIG. 1, first bag pack support tray 14 is provided. The first support tray 14 has a first base 18, a first left side wall 22, a first right side wall 26, a first back wall 30, a first front wall 34 and is sized and shaped to hold a first merchandise bag pack 38. The first front wall 34 has a first opening 42. The first opening 42 is sized and shaped to permit extraction of first bags 46 from the first bag pack 38.

Figure 1:
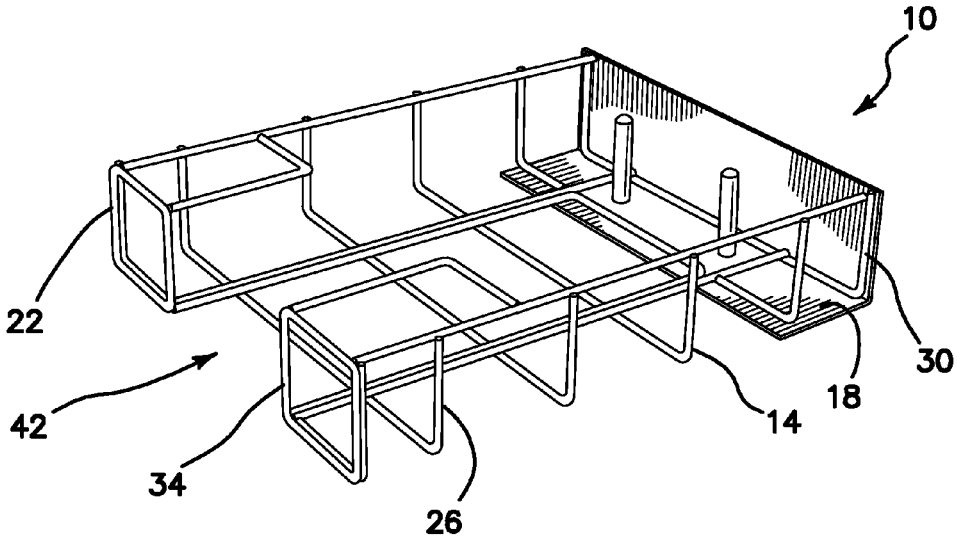
FIG. 1 is a perspective view of the preferred embodiment of the invention illustrating a single dispensing tray.
Figure 2:
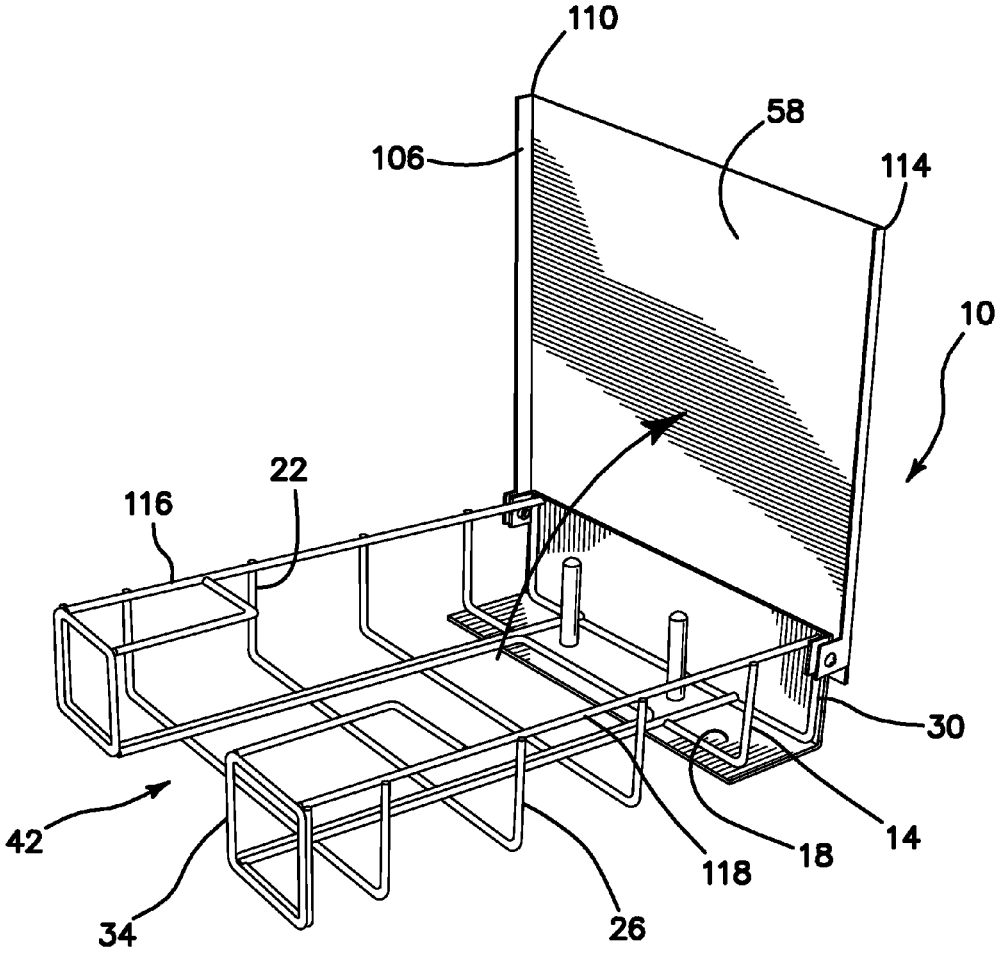
FIG. 2 is a perspective view of the of the FIG. 1 embodiment with a cover for the tray in an open position.
Figure 3:
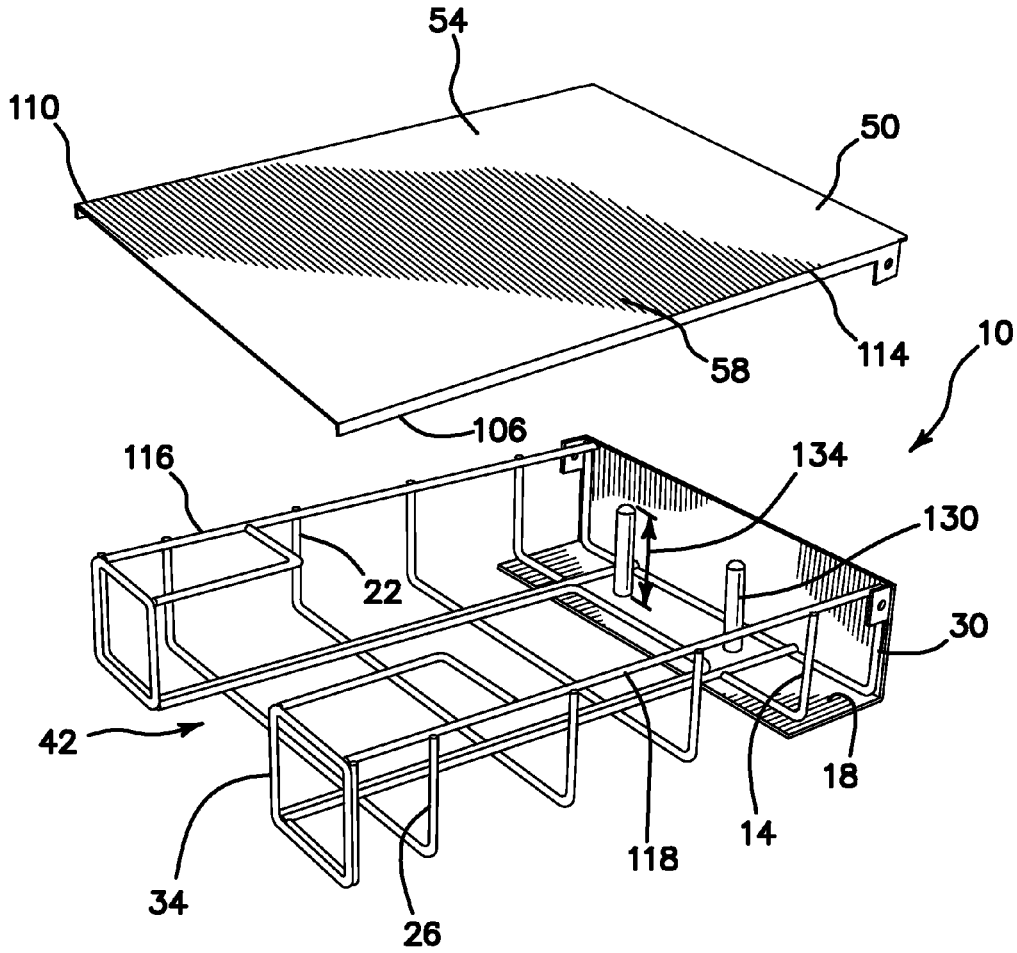
FIG. 3 is a perspective view of the FIG. 1 embodiment with the cover detached illustrating the mounting spikes.

(2) In a variant of the invention, as illustrated in FIGS. 2 and 3, a cover plate 50 is provided. The cover plate 50 is sized and shaped to cover at least a portion of the first bag pack support tray 14. The cover plate 50 provides either a loading surface 54 or an advertising display surface 58 above the first bag pack support tray 14.

(3) In another variant, the cover plate 50 is hingedly attached adjacent one of the first left side wall 22, the first right side wall 26, the first back wall 30 and the first front wall 34.

Figure 18:
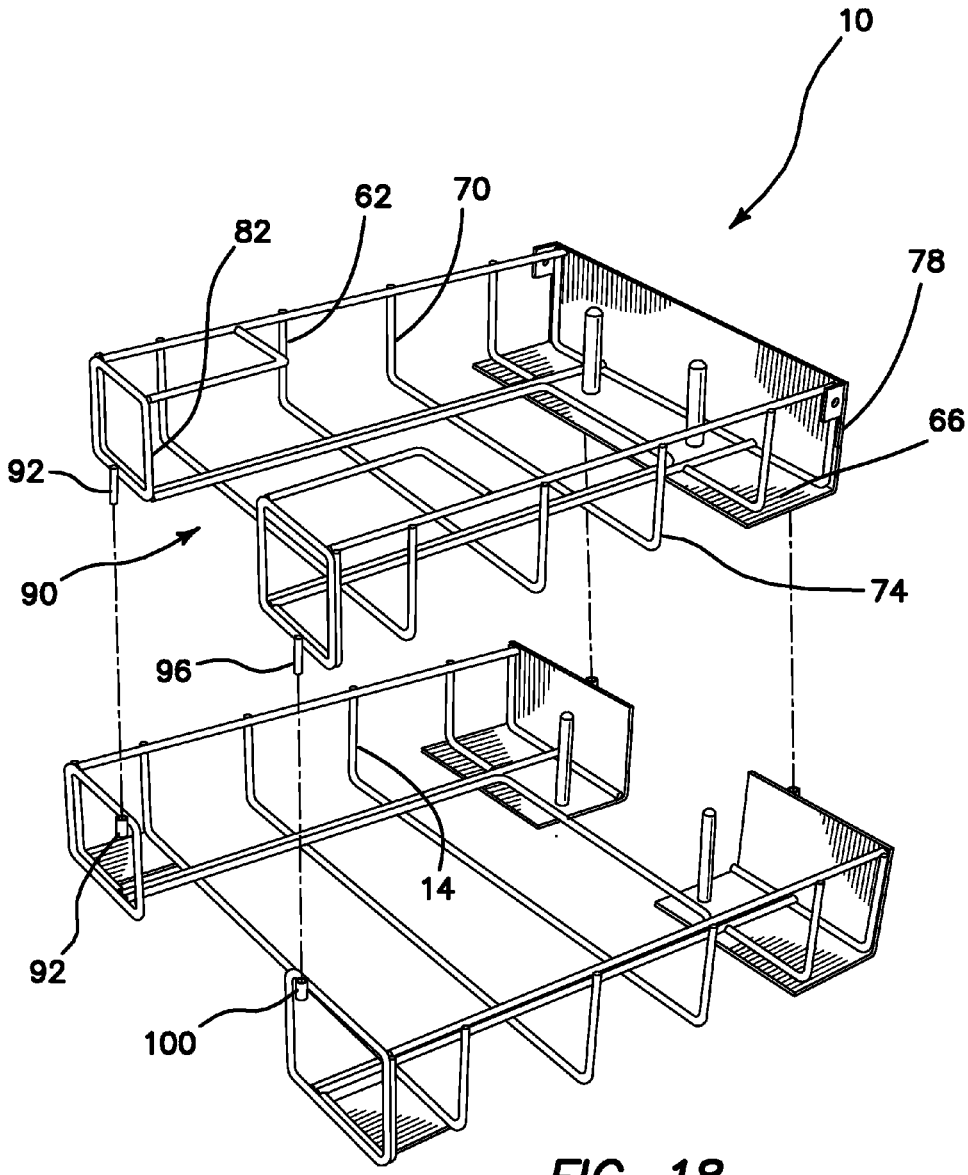
FIG. 18 is an exploded perspective view of the FIG. 6 embodiment illustrating the bag dispensing trays joined by pins and sockets.
Figure 19:
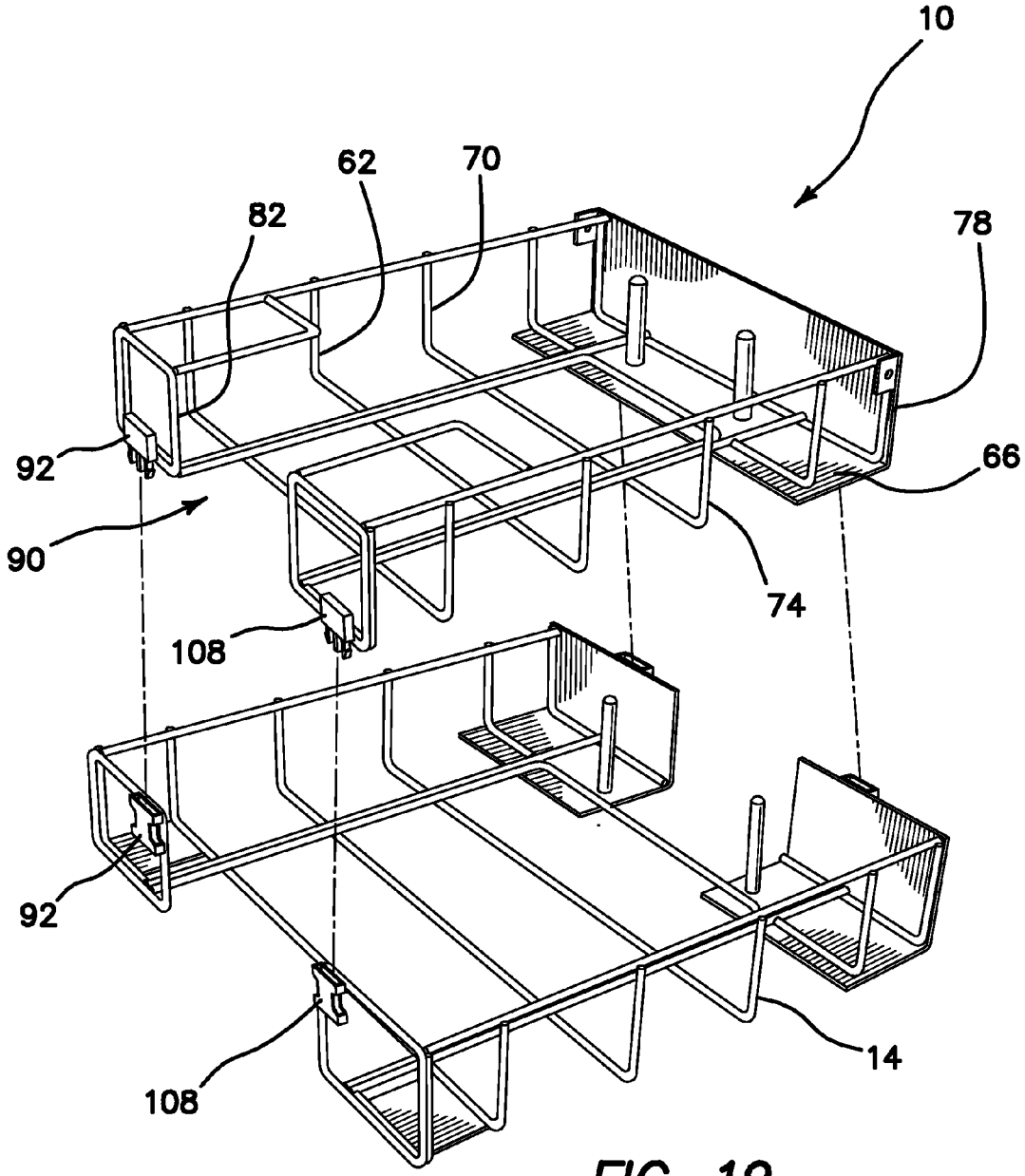
FIG. 19 is an exploded perspective view of the FIG. 6 embodiment illustrating the bag dispensing trays joined by clips.
Figure 20:
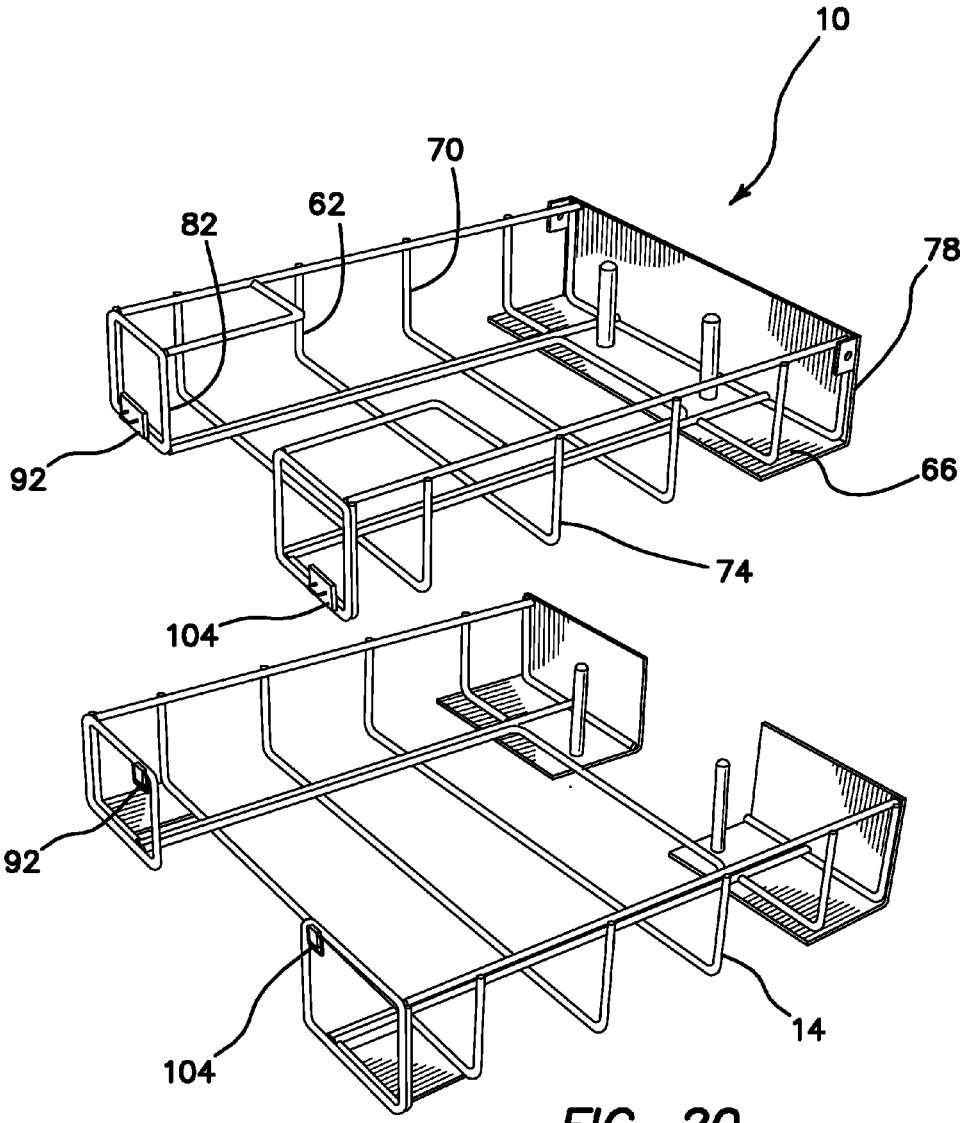
FIG. 20 is an exploded perspective view of the FIG. 6 embodiment illustrating the bag dispensing trays joined by buckles.

(4) In yet another variant, as illustrated in FIGS. 18-20, a second bag pack support tray 62 is provided. The second support tray 62 has a second base 66, a second left side wall 70, a second right side wall 74, a second back wall 78, a second front wall 82 and is sized and shaped to hold a second merchandise bag pack 86. The second front wall 82 has a second opening 90. The second opening 90 is sized and shaped to permit extraction of bags 94 from the second bag pack 86. The second bag pack support tray 62 is located on the first bag pack support tray 14.

(5) In still another variant, the second bag pack support tray 62 is secured to the first bag pack support tray 14 with at least one attachment mechanism 92.

(6) In a further variant, the at least one attachment mechanism 92 is selected from the group that includes pins 96 and sockets 100, buckles 104 and clips 108.

Figure 6:
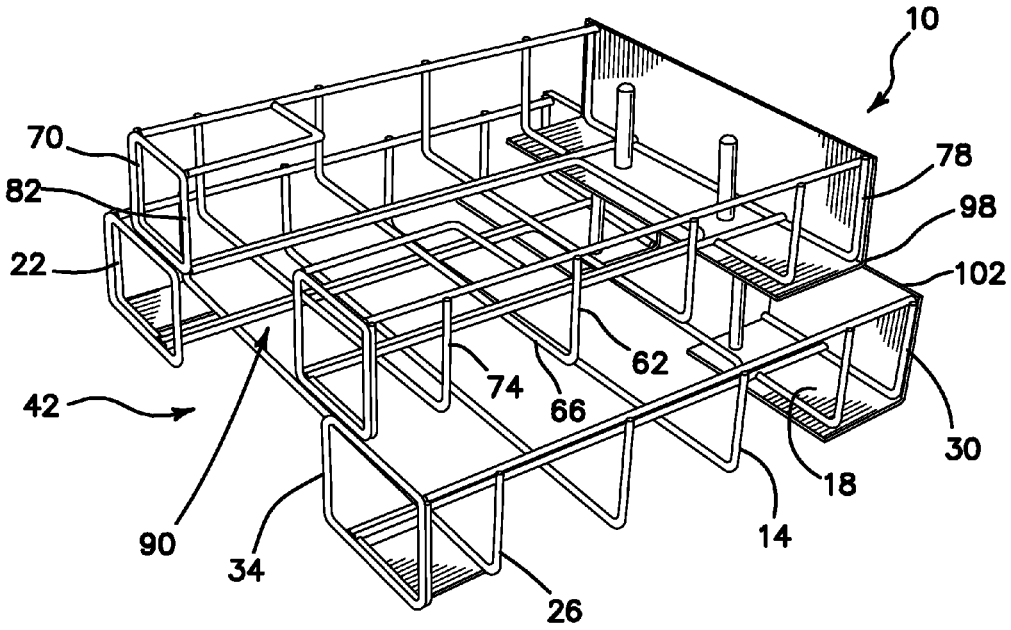
FIG. 6 is a perspective view of a second embodiment having two dispensing trays.
Figure 7:
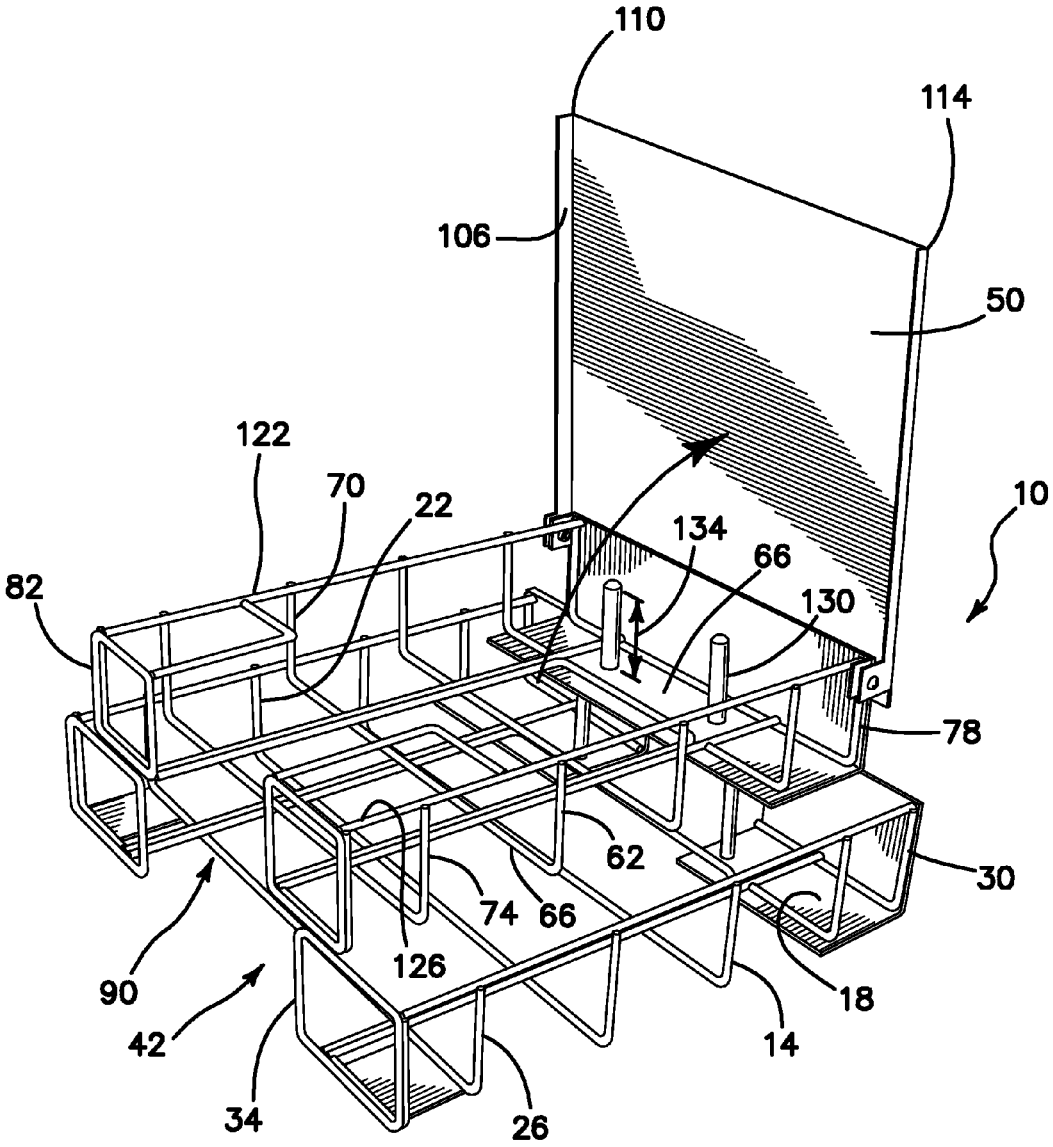
FIG. 7 is a perspective view of the FIG. 6 embodiment with two mounting spikes an a hinged cover.
Figure 8:
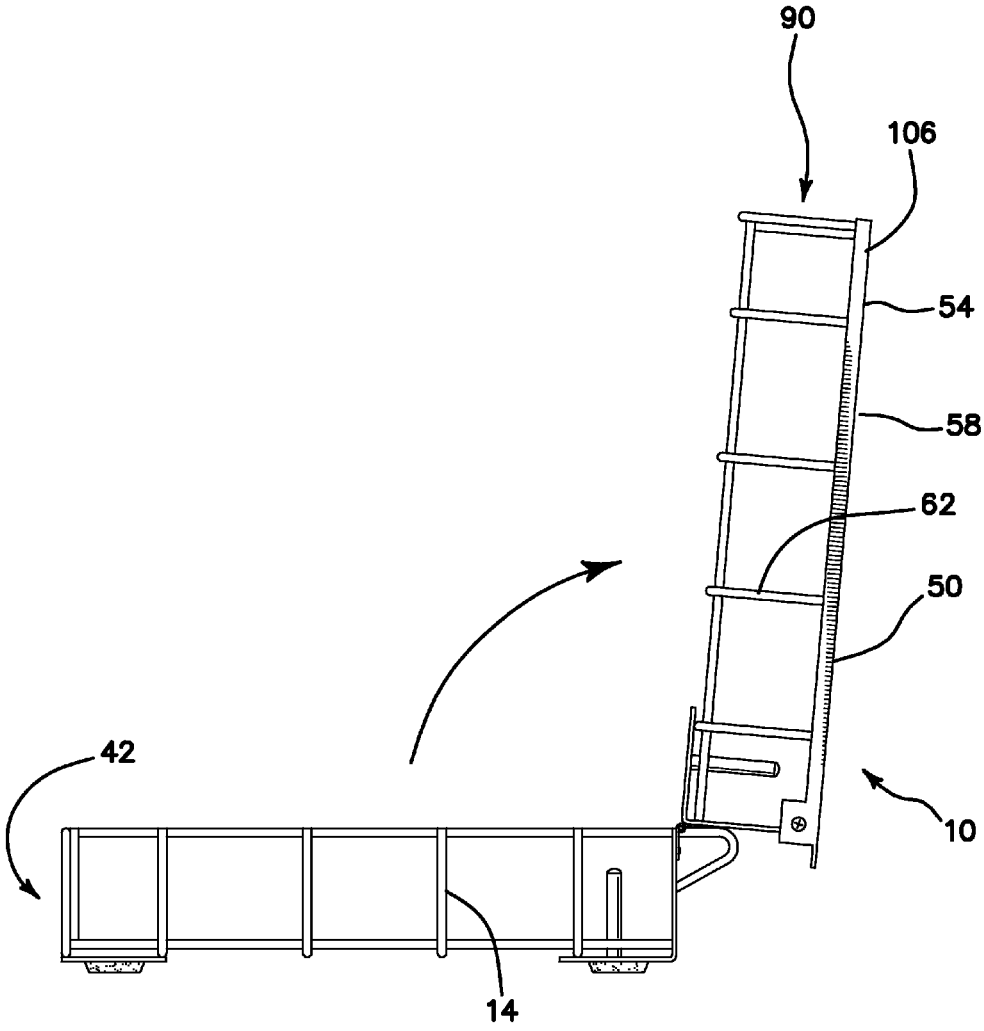
FIG. 8 is a side elevational view of the FIG. 7 embodiment illustrating the hinged attachment of the two dispensing trays.

(7) In still a further variant, as illustrated in FIGS. 6-8, the second bag pack support tray 62 is hingedly attached adjacent a lower edge 98 of the second back wall 78 adjacent an upper edge 102 of the first back wall 30. The second bag pack support tray 62 pivots upwardly to permit loading of a first bag pack 38 into the first bag pack support tray 14.

Figure 9:
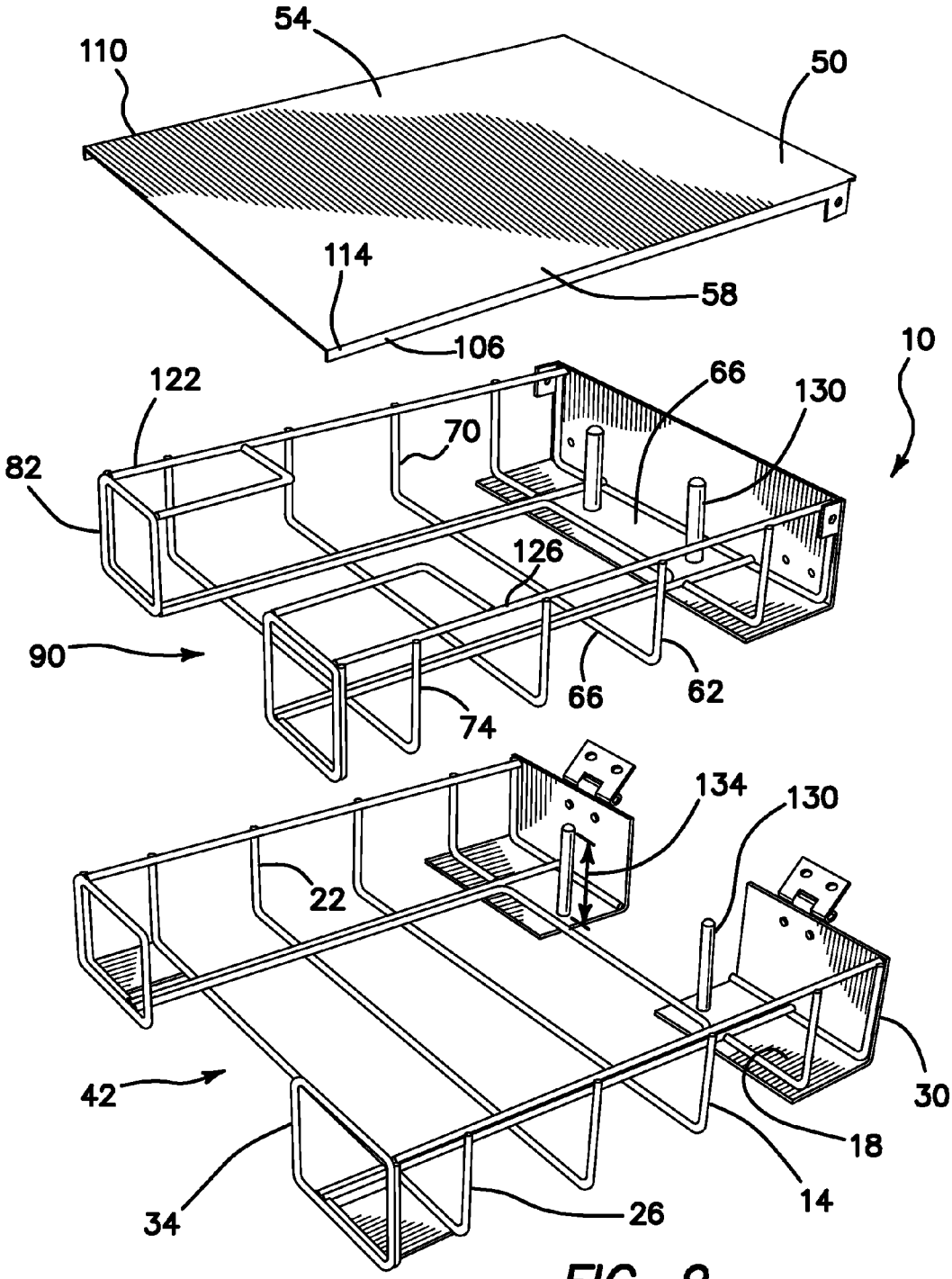
FIG. 9 is an exploded perspective view of the FIG. 7 embodiment illustrating two mounting spikes in each dispensing tray.

(8) In yet a further variant, as illustrated in FIGS. 7-9, a cover plate 50 is provided. The cover plate 50 is sized and shaped to cover at least a portion of the second bag pack support tray 62. The cover plate 50 provides either a loading surface 54 or an advertising display surface 58 above the second bag pack support tray 62.

(9) In another variant, the cover plate 50 is hingedly attached adjacent one of the second left side wall 70, the second right side wall 74, the second back wall 78 and the second front wall 82.

(10) In yet another variant, as illustrated in FIGS. 2 and 3, the cover plate 50 further includes at least one downward facing side ledge 106. The side ledge 106 is located at at least one of first 110 and second 114 side edges of the cover plate 50. The side ledge 106 is sized and shaped to extend downwardly over upper edges 116, 118 of at least one of the first left side wall 22 and the first right side wall 26, thereby stabilizing the cover plate 50 on the first bag pack support tray 14.

(11) In a further variant, as illustrated in FIGS. 7-9, the cover plate 50 further includes at least one downward facing side ledge 106. The side ledge 106 is located at at least one of first 110 and second 114 side edges of the cover plate 50. The side ledge 106 is sized and shaped to extend downwardly over upper edges 122, 126 of at least one of the second left side wall 70 and the second right side wall 74, thereby stabilizing the cover plate 50 on the second bag pack support tray 62.

Figure 4:
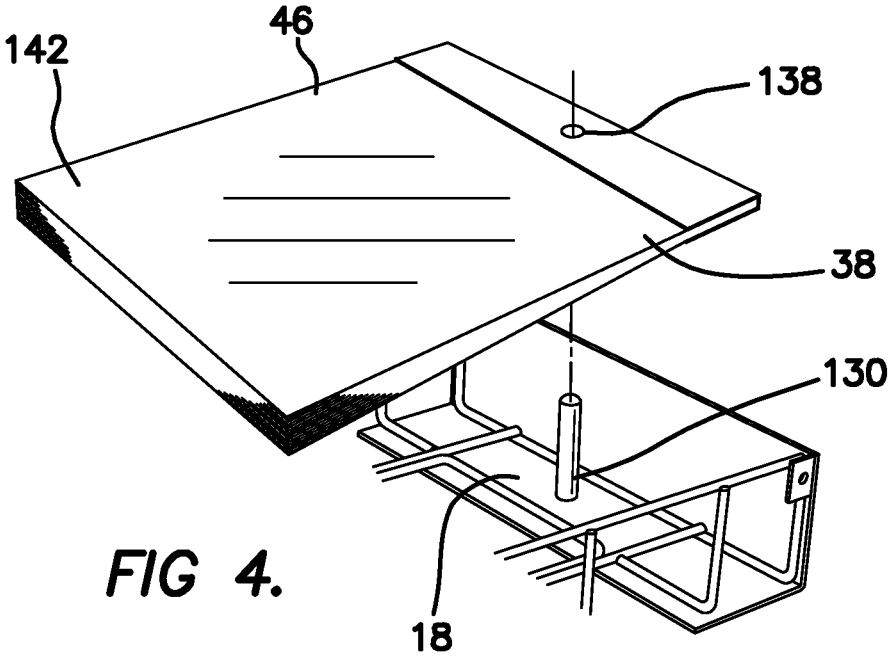
FIG. 4 is a partial perspective view of the FIG. 1 embodiment illustrating a single mounting spike and bag pack in a stacked configuration.
Figure 5:
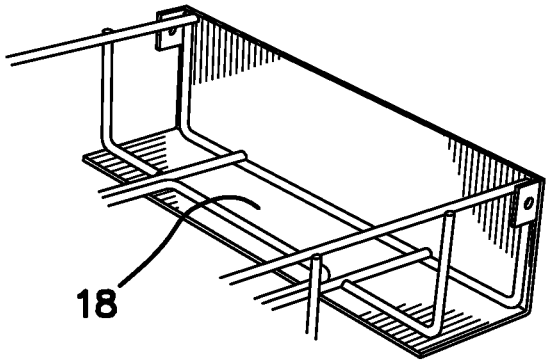
FIG. 5 is a partial perspective view of the FIG. 1 embodiment illustrating a tray without mounting spikes.

(12) In a further variant, as illustrated in FIGS. 3 and 4, at least one mounting spike 130 is provided. The at least one mounting spike 130 extends upwardly from the first base 18 for a first predetermined distance 134 and is located to align with an aperture 138 extending through the first bag pack 38.

(13) In yet a further variant, as illustrated in FIGS. 15A-17A, the at least one mounting spike 130 is removably attached to the first base 18.

(14) In still a further variant, the at least one mounting spike 130 is slidably attached to the first base 18 at a slot 20, thereby providing alternative locations for the mounting spike 130 on the first base 18.

(15) In another variant of the invention, at least one securing hook 132 is provided. The at least one securing hook 132 is attached to the first base 18 and is located to align with an aperture 136 extending through the first bag pack 38.

(16) In still another variant, the at least one securing hook 132 is removably attached to the first base 18.

(17) In yet another variant, the at least one securing hook 132 is slidably attached to the first base 18 at a slot 20, thereby providing alternative locations for the securing hook 132 on the first base 18.

(18) In still another variant, as illustrated in FIGS. 7-9, at least one mounting spike 130 is provided. The at least one mounting spike 130 extends upwardly from at least one of the first base 18 and the second base 66 for a first predetermined distance 134 and is located to align with an aperture 138 extending through either of the first bag pack 38 and the second bag pack 86.

(19) In a further variant, the at least one mounting spike 130 is removably attached to at least one of the first base 18 and the second base 66.

(20) In still a further variant, the at least one mounting spike 130 is movably attached to at least one of the first base 18 and the second base 66, thereby providing alternative locations for the mounting spike 130 on at least one of the first base 18 and the second base 66.

(21) In yet a further variant, at least one securing hook 132 is provided. The at least one securing hook 132 is attached to at least one of the first base 18 and the second base 66 and is located to align with an aperture 136 extending through at least one of the first bag pack 38 and the second bag pack 86.

(22) In another variant of the invention, the at least one securing hook 132 is removably attached to at least one of the first base 18 and the second base 66.

(23) In still another variant, the at least one securing hook 132 is movably attached to at least one of the first base 18 and the second base 66, thereby providing alternative locations for the securing hook 132 on at least one of the first base 18 and the second base 66.

(24) In yet another variant, the first bag pack support tray 14 is formed from materials selected from the group that includes wire, injection molded material, sheet metal and wood.

(25) In a further variant, at least one of the first bag pack support tray 14 and the second bag pack support tray 62 is formed from materials selected from the group that includes wire, injection molded material, sheet metal and wood.

(26) In still a further variant, as illustrated in FIG. 4, the first bag pack support tray 14 is sized and shaped to hold a plurality of merchandise bags 46 in a stacked configuration 142.

Figure 10:
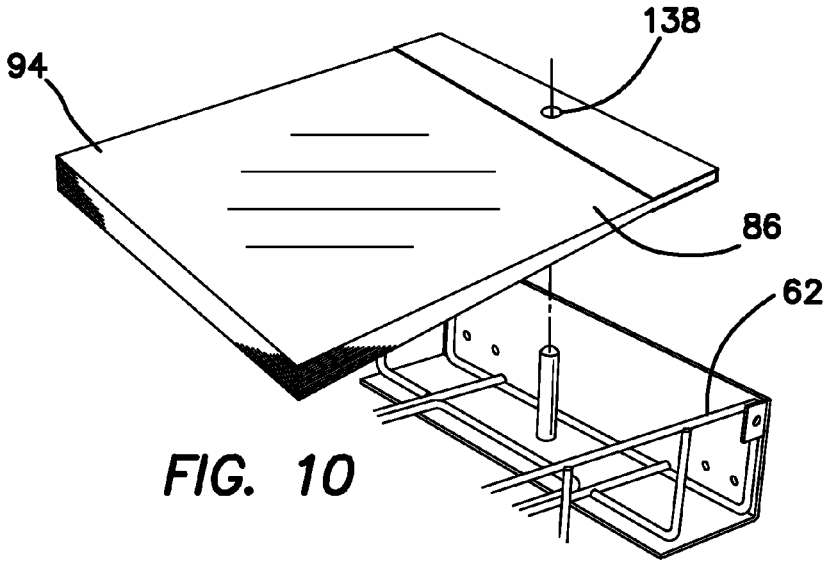
FIG. 10 is a partial perspective view of the upper dispensing tray illustrating a single mounting spike and a bag pack in a stacked configuration.
Figure 11:
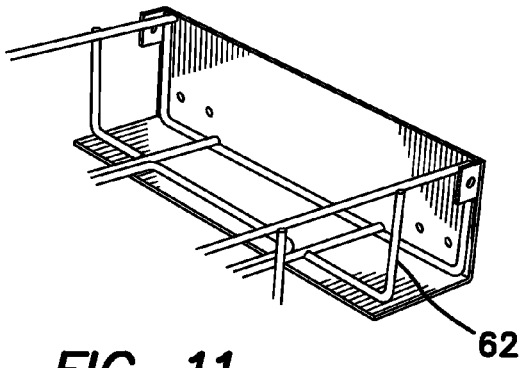
FIG. 11 is a partial perspective view of the upper dispensing tray without mounting spikes.
Figure 12:
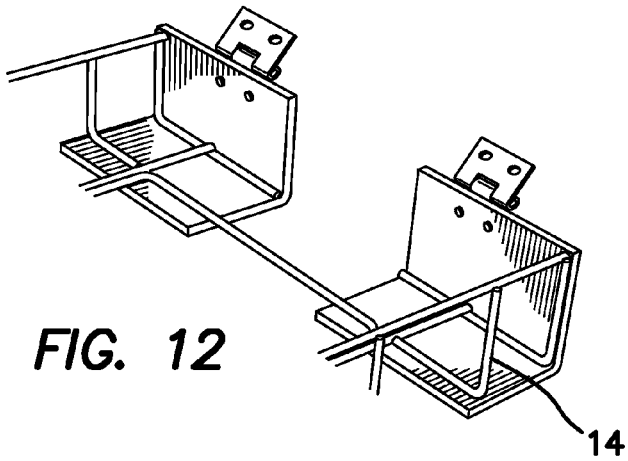
FIG. 12 is a partial perspective view of the lower dispensing tray without mounting spikes.
Figure 13:
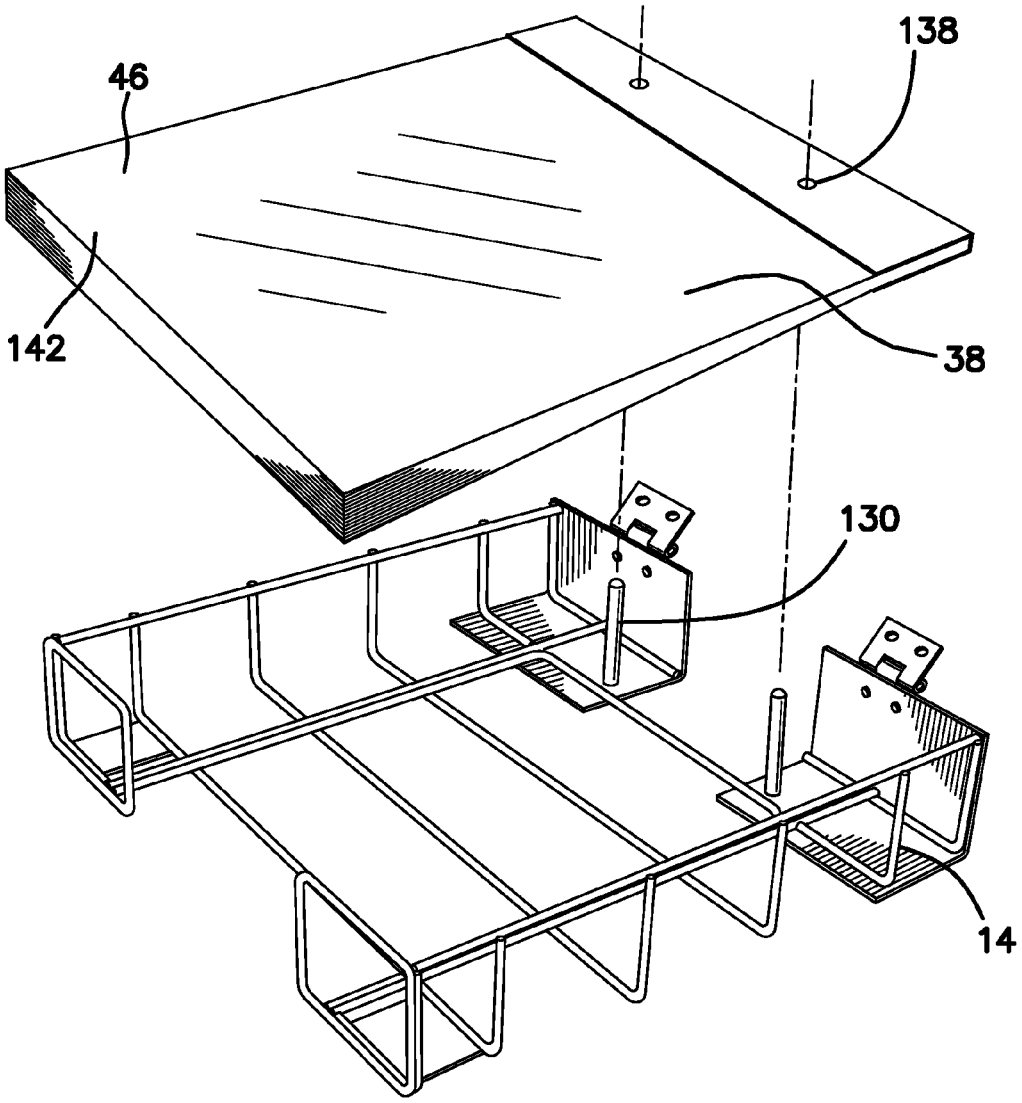
FIG. 13 is a perspective view of the lower dispensing tray illustrating dual mounting spikes and a bag pack in a stacked configuration.

(27) In yet a further variant, as illustrated in FIGS. 10 and 13, at least one of the first bag pack support tray 14 and the second bag pack support tray 62 is sized and shaped to hold a plurality of merchandise bags 46, 94 in a stacked configuration 142.

Figure 14:
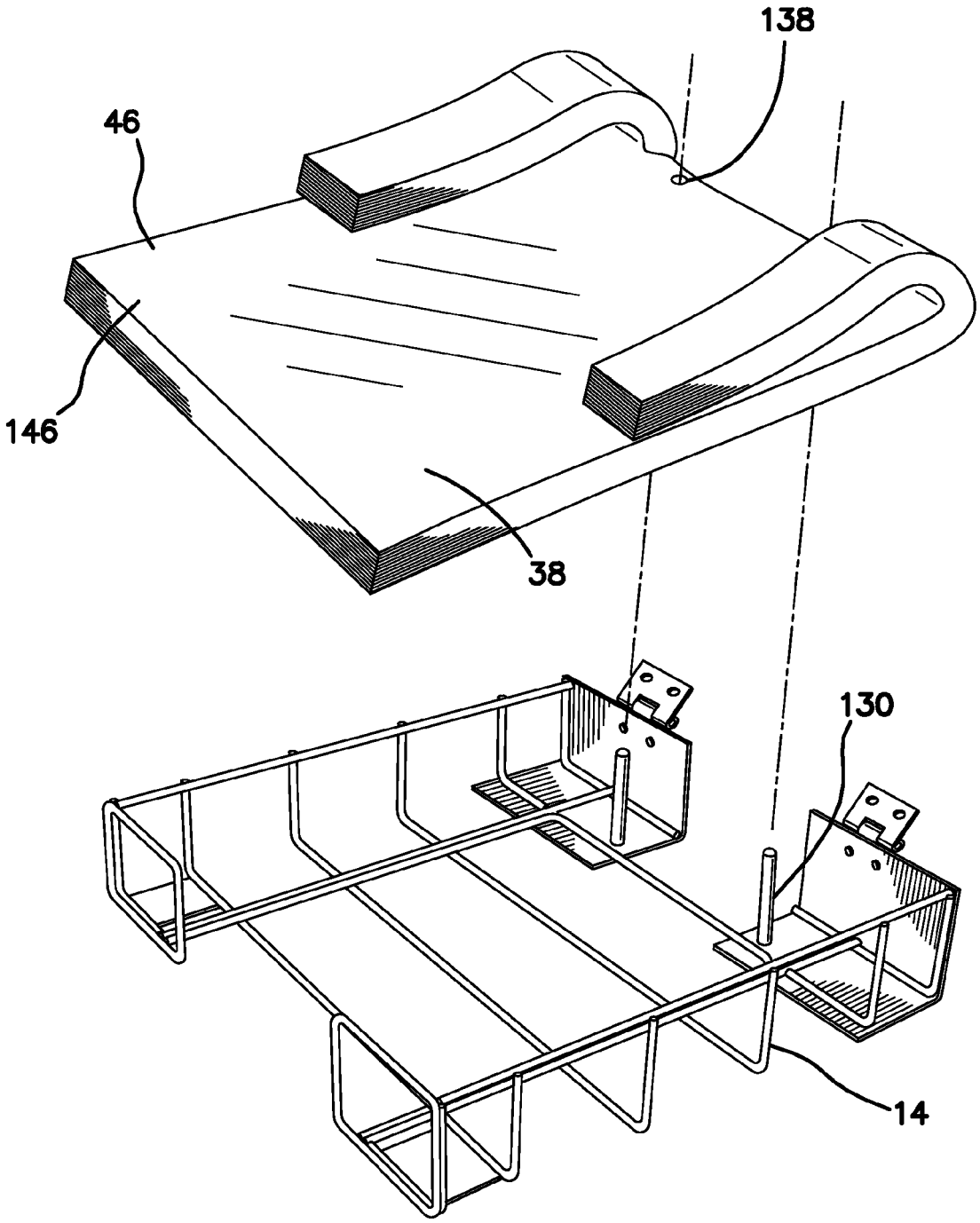
FIG. 14 is a perspective view of the lower dispensing tray illustrating dual mounting spikes and a bag pack in a folded configuration.
Figure 15:
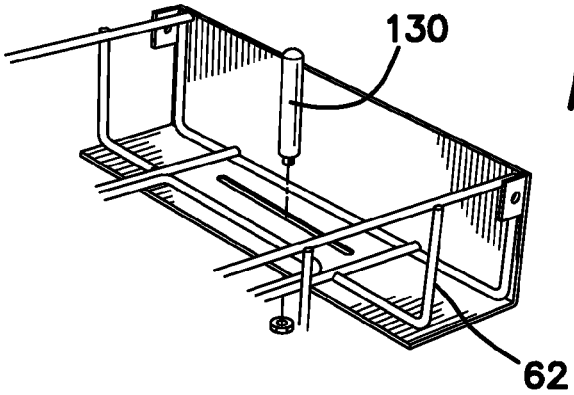
FIG. 15 is a partial perspective view of an upper dispensing tray illustrating a removable/movable mounting spike capable of side to side movement.
Figure 16:
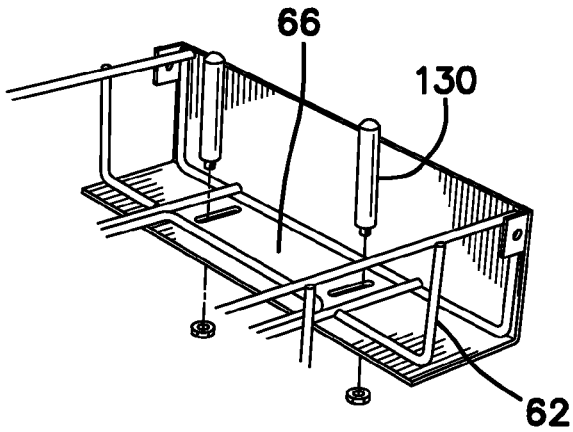
FIG. 16 is a partial perspective view of an upper dispensing tray illustrating a removable/movable mounting spike capable of front to rear movement.
Figure 17:
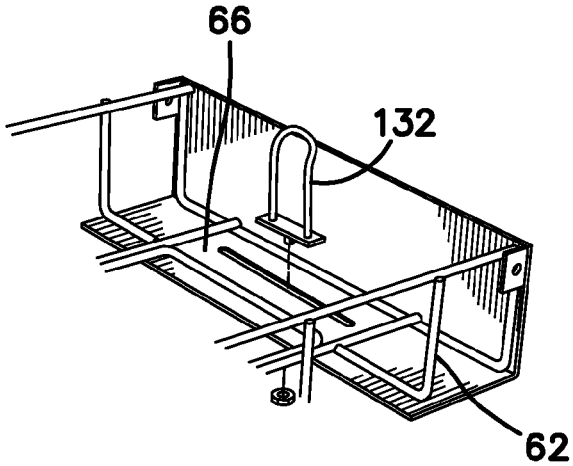
FIG. 17 is a partial perspective view of an upper dispensing tray illustrating a removable/movable dispensing hook capable of side to side to side movement.
Figure 15A:
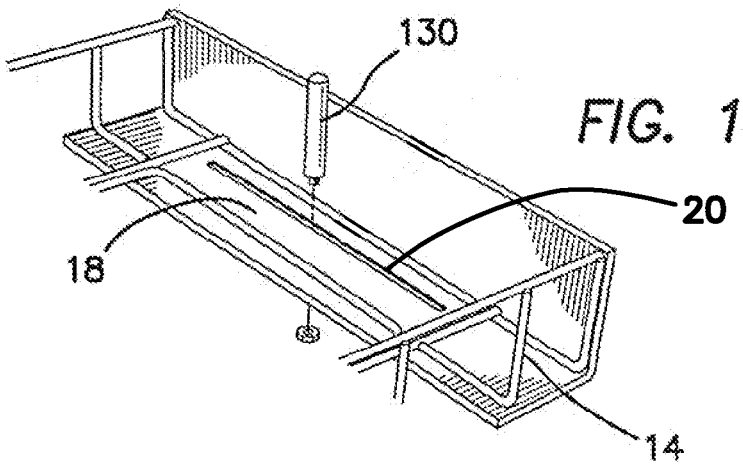
FIG. 15A is a partial perspective view of a lower dispensing tray illustrating a removable/movable mounting spike capable of side to side movement.
Figure 16A:
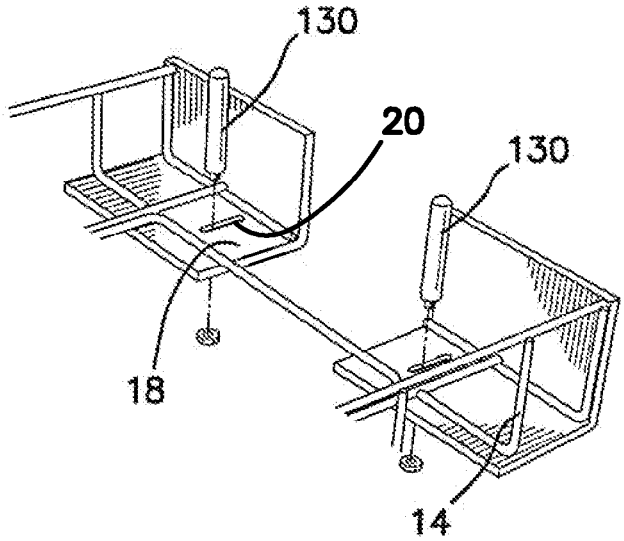
FIG. 16A is a partial perspective view of a lower dispensing tray illustrating a removable/movable mounting spike capable of front to rear movement.
Figure 17A:
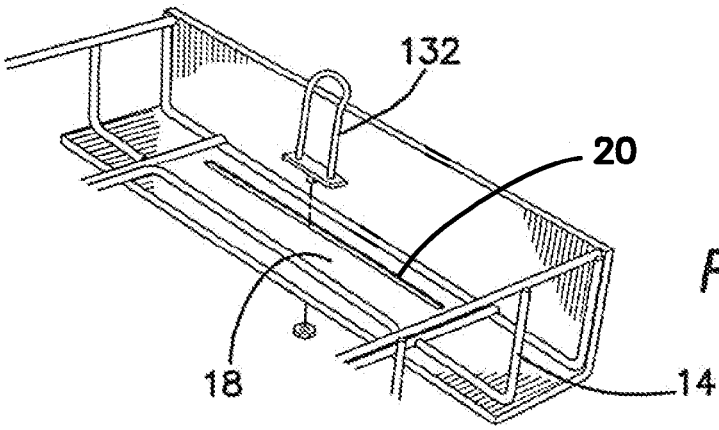
FIG. 17A is a partial perspective view of a lower dispensing tray illustrating a removable/movable dispensing hook capable of side to side to side movement.

(28) In another variant of the invention, as illustrated in FIG. 14, the first bag pack support tray 14 is sized and shaped to hold a plurality of merchandise bags 46 in a folded configuration 146.

(29) In a final variant of the invention, at least one of the first bag pack support tray 14 and the second bag pack support tray 62 is sized and shaped to hold a plurality of merchandise bags 46, 94 in a folded configuration 146.

The invention claimed is:

1. A bag dispenser rack, comprising:

a first bag pack, said first bag pack comprising a plurality of bags;

a first bag pack support tray, said first support tray having a first panel base, a first left side wall, a first right side wall, a first back wall, a first front wall and being sized and shaped to hold said first bag pack;

said first front wall having a first opening, said first opening sized and shaped to permit extraction of bags from said first bag pack;

an elongated slot, said slot disposed in said first panel base;

at least one mounting spike, said at least one mounting spike being attached directly to said elongated slot and extending upwardly from said first panel base for a first predetermined distance and being disposed to align with an aperture extending through said plurality of bags in said first bag pack;

said at least one mounting spike having a width no greater than said diameter aperture for said first predetermined distance;

said at least one mounting spike is removable and slidable within said elongated slot in said first panel base, thereby providing adjustable alternative locations for said mounting spike on said first panel base to accommodate merchandise bag packs with various mounting aperture locations.

2. The bag dispenser rack, as described in claim 1, further comprising:

a cover plate, said cover plate being sized and shaped to cover at least a portion of said first bag pack support tray; and said cover plate providing either of a loading surface and an advertising display surface above said first bag pack support tray.

3. The bag dispenser rack, as described in claim 2, wherein said cover plate is hingedly attached adjacent one of said first left side wall, said first right side wall, said first back wall and said first front wall.

4. The bag dispenser rack, as described in claim 1, further comprising:

a second bag pack support tray, said second support tray having a second base, a second left side wall, a second right side wall, a second back wall, a second front wall and being sized and shaped to hold a second merchandise bag pack;

said second front wall having a second opening, said second opening sized and shaped to permit extraction of second bags from said second bag pack;

said second bag pack support tray being disposed upon said first bag pack support tray.

5. The bag dispenser rack, as described in claim 4, wherein said second bag pack support tray is secured to said first bag pack support tray with at least one attachment mechanism.

6. The bag dispenser rack, as described in claim 5, wherein said at least one attachment mechanism is selected from the group comprising pins and sockets, buckles and clips.

7. The bag dispenser rack, as described in claim 4, further wherein:

said second bag pack support tray is hingedly attached adjacent a lower edge of said second back wall adjacent an upper edge of said first back wall; and said second bag pack support tray pivots upwardly to permit loading of a first bag pack into said first bag pack support tray.

8. The bag dispenser rack, as described in claim 4, further comprising:

a cover plate, said cover plate being sized and shaped to cover at least a portion of said second bag pack support tray; and said cover plate providing either of a loading surface and an advertising display surface above said second bag pack support tray.

9. The bag dispenser rack, as described in claim 8, wherein said cover plate is hingedly attached adjacent one of said second left side wall, said second right side wall, said second back wall and said second front wall.

10. The bag dispenser rack, as described in claim 2, wherein said cover plate further comprises at least one downward facing side ledge, said side ledge disposed at at least one of first and second side edges of said cover plate and being sized and shaped to extend downwardly over upper edges of at least one of said first left side wall and said first right side wall, thereby stabilizing said cover plate on said first bag pack support tray.

11. The bag dispenser rack, as described in claim 8, wherein said cover plate further comprises at least one downward facing side ledge, said side ledge disposed at at least one of first and second side edges of said cover plate and being sized and shaped to extend downwardly over upper edges of at least one of said second left side wall and said second right side wall, thereby stabilizing said cover plate on said second bag pack support tray.

12. The bag dispenser rack, as described in claim 1, further comprising at least one securing hook, said at least one securing hook being attached to said first base and being disposed to align with an aperture extending through said first bag pack.

13. The bag dispenser rack, as described in claim 12, wherein said at least one securing hook is removably attached to said first base.

14. The bag dispenser rack, as described in claim 13, wherein said at least one securing hook is movably attached to said first base, thereby providing alternative locations for said securing hook on said first base.

15. The bag dispenser rack, as described in claim 4, further comprising at least one mounting spike, said at least one mounting spike extending upwardly from at least one of said first base and said second base for a first predetermined distance and being disposed to align with an aperture extending through either of said first bag pack and said second bag pack.

16. The bag dispenser rack, as described in claim 15, wherein said at least one mounting spike is removably attached to at least one of said first base and said second base.

17. The bag dispenser rack, as described in claim 15, wherein said at least one mounting spike is movably attached to at least one of said first base and said second base, thereby providing alternative locations for said mounting spike on at least one of said first base and said second base.

18. The bag dispenser rack, as described in claim 4, further comprising at least one securing hook, said at least one securing hook being attached to at least one of said first base and said second base and being disposed to align with an aperture extending through at least one of said first bag pack and said second bag pack.

19. The bag dispenser rack, as described in claim 18, wherein said at least one securing hook is removably attached to at least one of said first base and said second base.

20. The bag dispenser rack, as described in claim 18, wherein said at least one securing hook is movably attached to at least one of said first base and said second base, thereby providing alternative locations for said securing hook on at least one of said first base and said second base said first base.

21. The bag dispenser rack, as described in claim 1, wherein said first bag pack support tray is formed from materials selected from the group comprising:

wire, injection molded material, sheet metal and wood.

22. The bag dispenser rack, as described in claim 4, wherein at least one of said first bag pack support tray and said second bag pack support tray is formed from materials selected from the group comprising:

wire, injection molded material, sheet metal and wood.

23. The bag dispenser rack, as described in claim 1, wherein said first bag pack support tray is sized and shaped to hold a plurality of merchandise bags in a stacked configuration.

24. The bag dispenser rack, as described in claim 4, wherein at least one of said first bag pack support tray and said second bag pack support tray is sized and shaped to hold a plurality of merchandise bags in a stacked configuration.

25. The bag dispenser rack, as described in claim 1, wherein said first bag pack support tray is sized and shaped to hold a plurality of merchandise bags in a folded configuration.

26. The bag dispenser rack, as described in claim 4, wherein at least one of said first bag pack support tray and said second bag pack support tray is sized and shaped to hold a plurality of merchandise bags in a folded configuration.

* * * * *